US005430622A

United States Patent [19]

Kuo

[11] Patent Number: 5,430,622

[45] Date of Patent: Jul. 4, 1995

[54] LIGHT EMITING TORCH

[76] Inventor: Ming-Shish Kuo, 26-1, Alley 43, Lane 344, Jong-Jeng Road, Yung-Kang, Tainan Shien, Taiwan

[21] Appl. No.: 202,763

[22] Filed: Feb. 28, 1994

[51] Int. Cl.[6] ..... F21K 2/06

[52] U.S. Cl. ..... 362/34; 362/159; 206/219

[58] Field of Search ..... 362/34, 84, 101, 159; 206/219, 221

[56] References Cited

U.S. PATENT DOCUMENTS 3,539,794 11/1970 Rauhut et al. ..... 362/34
4,064,428 12/1977 Van Zandt ..... 362/34
4,556,325 12/1985 Katzin ..... 206/219
4,959,756 9/1990 Dodson ..... 362/34
5,067,051 11/1991 Ladyjensky ..... 362/34
5,325,273 6/1994 Kuo ..... 362/34

*Primary Examiner*—Ira S. Lazarus
*Assistant Examiner*—Alan B. Cariaso

[57] ABSTRACT

A light emitting torch comprises a transparent tube. The tube defines a space by the inner wall and an opening thereof. A partition is removably attached to the inner wall of the tube and defines a first chamber and a second chamber therein. A first and a second chemical substance are loaded into the first and the second chambers. A cap is attached to the opening of the tube to seal the chemical substance therein.

1 Claim, 4 Drawing Sheets

LIGHT EMITING TORCH

BACKGROUND OF THE INVENTION

This invention relates to a torch, more particularly, to a light emitting torch which contains two different kind of chemical substance and the light is emitted when two chemical substance are blended.

In a conventional light emitting torch, two different chemical substance are sealed in a transparent tube. Those two different chemical are separated by a breakable partition. When the partition is broken by twisting or bending the tube, those two chemical substance are blended and the light is emitted resulted from the chemical reaction between two chemical substance.

As shown in FIG. 1, the conventional torch I which defines a tube 10 is sealed with two chemical substance. Those two chemical substance are separated by a breakable glass tube 11. The glass tube 11 can be broken when the tube 10 is bent. When the glass tube 11 is broken, those two chemical substance are blended, as a result, a chemical light is emitted.

Although the conventional torch 1 can emit the light, the manufacturing of this conventional torch 1 is difficult. First, the first chemical substance, such as oxalic acid, shall be sealed in the glass tube 11. Then the second chemical substance, such as hydrogen peroxide, is sealed in the tube 10. From these above description, the chemical substance can be stuffed in a time. Besides, since the chemical substance are resides on both ends of the tube 10 and glass tube 11, the chemical reaction can not be blended completely.

SUMMARY OF THE INVENTION

It is the object of this invention to provide a light emitting torch wherein the chemical substance can be loaded and sealed within the tube in a single manufacturing process.

In order to achieve the object set forth, the light emitting torch comprises a transparent tube which defines a two different chambers by a partition. The partition is attached to inner wall of said tube. Each of those two isolated chambers is loaded with two different chemical substance. When the partition is deprived from the inner wall of the tube, those two chemical substance are blended and the light is emitted.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively the examples of a shoes with a light emitting torch. Wherein.

DETAILED DESCRIPTION OF A PREFERABLE EMBODIMENT

Figure 1:
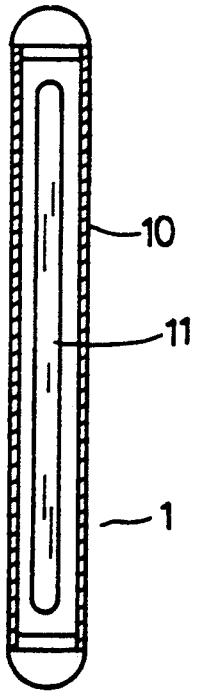
FIG. 1 (PRIOR ART)
FIG. 1 is a cross sectional view of a conventional torch.
Figure 2:
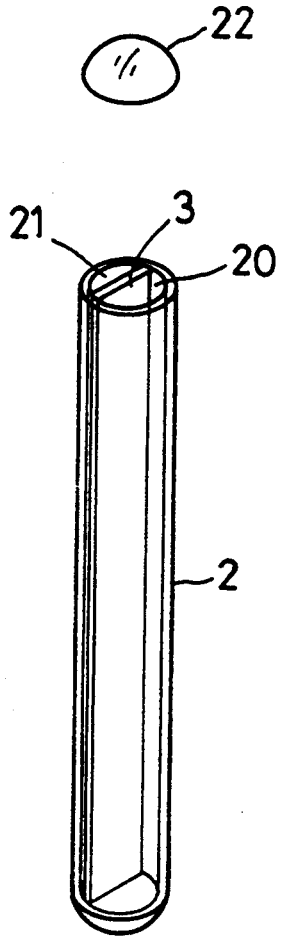
FIG. 2 is a perspective view of a light emitting torch made according to this invention.
Figure 3:
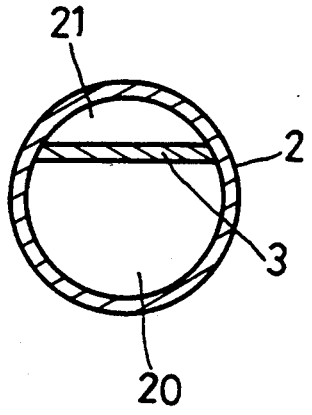
FIG. 3 is a cross sectional view of a light emitting torch made according to this invention.

Referring to FIGS. 2 and 3, the light emitting torch made according to this invention comprises a transparent tube 2 which is made from plastic material, such as PP or PE. The tube 2 defines a inner space by its inner wall and an opening thereof. A partition 2 is removably attached to the inner wall of the tube 2, accordingly, a longitudinal first chamber 20 and a second chamber 21 are defined thereof by the partition 3. The volume of the first chamber 20 and the second chamber 21 are different. The connection between the inner wall of the tube 2 and the partition is breakable.

In manufacturing, the tube 2 is injected direction form an injecting machine, then the partition 3 is attached to the inner wall of the tube 2. Accordingly, the first chemical substance, such as oxalic acid, and a second chemical substance, such as hydrogen peroxide, are loaded into the first chamber 20 and the second chamber 21 in a predetermined proportion. After those two chemical substance are loaded, a cap 22 are attached to the opening of the tube 2 to seal those two chemical substance therein. At last, the manufacturing of the light emitting torch is made. From above description, the manufacturing process of the light emitting torch of this invention is more simple than the conventional torch.

Figure 5:
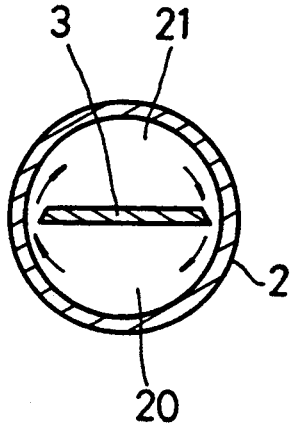
FIG. 5 is a cross sectional view of the torch viewed from the A—A line of the FIG. 4.
Figure 4:
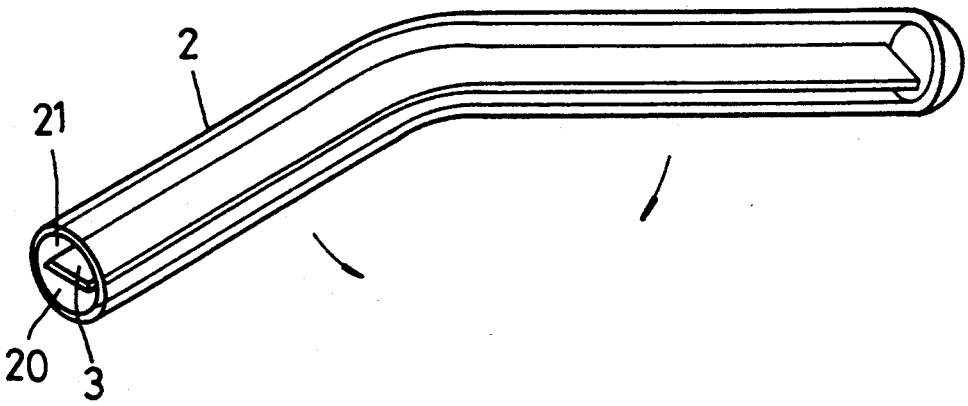
FIG. 4 is a sketch view showing those two chemical substance are blent when the partition is deprived from the inner wall of the tube resulted from the deform of the tube.

When the tube 2 is bent, the partition 3 is deprived from the inner wall of the tube 2, as shown in FIGS. 4 and 5. Accordingly, those two loaded chemical substance are blended together, a light is emitted as a chemical reaction is achieved.

The light emitting torch made according to this invention can be concluded with the following advantages.

1. Those chemical substance can be loaded to the tube in a single manufacturing process. A mass production can be easily made.
2. The manufacturing cost decrease considerably since the manufacturing process is simple.
3. The manufacturing process is efficient and economic. A mass production and quick production is achieved.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claim.

I claim:

1. A light emitting torch comprising:

a flexible transparent tube made from a chemically stable material, a first end of said tube being closed and a second end of said tube being open;

a longitudinal partition removably affixed to an inner wall of said tube, said partition defining a first longitudinal chamber and a second longitudinal chamber, said partition being installed in a plane which is not a diameter of the tube such that the first chamber is not the same size as the second chamber;

a first chemical substance is contained in the first chamber and a second chemical substance is contained in the second chamber; and a cap is used to seal the open end of said tube; such that when said elastic tube is bent by a user, the partition is broken from the walls of the tube, thus allowing the first and the second chemical substances to mix together, thereby causing a reaction that produces light.

* * * * *